United States Patent [19]

Hoglund

[11] 4,356,669

[45] Nov. 2, 1982

[54] CAM CONTROL GRINDING MACHINE

[76] Inventor: Nils Hoglund, 100 E. Linton Blvd., Ste. 408B, Delray Beach, Fla. 33444

[21] Appl. No.: 314,308

[22] Filed: Oct. 23, 1981

[51] Int. Cl.[3] ..... B24B 17/02

[52] U.S. Cl. ..... 51/101 R; 51/50 PC; 51/DIG. 32; 408/54; 409/104; 409/111; 409/211

[58] Field of Search ..... 51/101 R, 105 EC, 290, 51/DIG. 14, DIG. 32, 99, 50 PC; 408/54; 409/97, 104, 111, 112, 122, 123, 199, 211

[56] References Cited

U.S. PATENT DOCUMENTS

| | | | |
|---|---|---|---|
| 3,663,188 | 5/1972 | Hoglund | 51/101 R |
| 3,693,297 | 9/1972 | Cann | 51/101 R X |
| 3,822,511 | 7/1974 | Hoglund | 51/DIG. 32 X |
| 3,828,481 | 8/1974 | Uhtenwoldt | 51/101 R |
| 3,902,278 | 9/1975 | Uhtenwoldt | 51/50 PC |
| 3,921,339 | 11/1975 | Kikuchi | 51/DIG. 32 X |
| 3,943,665 | 3/1976 | Nagashima | 51/101 R |
| 4,005,552 | 2/1977 | Hoglund et al. | 51/DIG. 32 X |

*Primary Examiner*—Stephen G. Kunin
*Assistant Examiner*—Robert P. Olszewski
*Attorney, Agent, or Firm*—Eugene F. Malin

[57] ABSTRACT

A grinding apparatus for forming and grinding complex curved surfaces such as the peritrochordal bore of rotary a combustion engine, e.g. Wankel engine, having a cam member with a surface corresponding to the surface of the workpiece to be ground, a grinding wheel, a turntable for fixing the workpiece for rotational movement with the cam member, drive elements for rotating the turntable and workpiece against the grinding wheel, a cam follower connected to a device for supporting and moving the grinding wheel in response to cam follower movement as it traces the cam member contour, and a normalty control device for pivoting the grinding wheel support about the axis of rotation of the cam follower to maintain perpendicularity of a plane passing through the axis of the grinding wheel, the cam follower axis, the contact point between the grinding wheel and the work surface, and the contact point between the cam follower and cam member normal to the tangent line of the work surface contour at the contact point between grinding wheel and work surface. The normalty control device in combination with grinder moving device automatically compensates for grinding wheel wear.

15 Claims, 9 Drawing Figures

CAM CONTROL GRINDING MACHINE

BACKGROUND OF THE INVENTION

In manufacturing structural elements such as metal machine parts, it is often necessary that the elements have a finished surface of particular design and shape. As an example, machine elements which are adapted to cooperate in a sliding, gearing or camming relation must have cooperating surfaces of precise shape. Where these surfaces are straight, circular, or some other common shape, the machining or surfacing is not too difficult. Where, however, the desired surface of the element is a complicated curve, as for example, one having an ever changing radius of curvature, the machining thereof becomes both difficult and expensive.

Where tolerances are critical, a grinding machine is usually employed. Grinding machines can produce extremely accurate surfaces; but when these surfaces are of unusual shape, the expense of constructing the machine to perform the particular grinding operation is often prohibitive. It may, for example, take a number of separate grinding operations to produce a particular complex surface with each of the grinding operations requiring that the workpiece be fed through a separate grinding machine. Also, with presently available grinding machines, the feeding of the workpiece relative to the grinding wheel is difficult to control both with regard to its direction of movement and rate of feed past the grinding wheel. Different sized grinding wheels generally require that the workpiece be fed through different paths in order to produce the same surface. Similarly, as the grinding wheel becomes worn during a grinding operation, adjustments in the direction of movement of the workpiece must be made in order to maintain the desired surface cut. This is especially true where a curved surface is desired. In addition to the problems encountered with different sized grinding wheels, any changes in rate of feed of the workpiece relative to the grinding wheel adversely affects both efficiency of operation and the quality of the finished surface. Different grinding rates produce different surface finishes. This, in turn, necessitates further processing of the workpiece to obtain uniformity.

One area which is particularly sensitive to the quality of the surface produced is in the machining of the stator cavity of a rotary combustion engine e.g. a Wankel engine. The cavity of such an engine has the contour of a peritrochoid which lies outside the theoretical trochoid of the engine by an amount equal to the apex radius of the rotor seal. Without a precision ground and finished peritroidal surface, wear caused by the internally driven rotor engaging against this surface through the apex seal occurs unacceptably fast. Also, the functioning of the engine is adversely affected by an improper mating of the rotor seal with the cavity wall surface of the stator due to inaccuracy in the geometric shape of the peritrochoid.

Several methods have been employed to control the relative movement between the work surface and the grinding tool so as to produce a true peritroichoid cavity contour. One means, revealed in the Baier U.S. Pat. No. 2,870,578, reveals a mechanism for reconstructing, through various spur gears and linkage arms, the theoretical trochoidal contour. The apparatus, although functional, is expensive and time consuming.

Another means for machining a peritrochoidal contour is revealed in an earlier U.S. Pat. No. 3,663,188 wherein I revealed use of a cam which linearly moved the spindle around which the workpiece was revolved. However, when a cam is so employed, a means for maintaining a normalty relation between the grinder at the contact point of the work surface and the contact point of the follower to the cam is required. In that patent, I used an annular cam with cam followers against both the inner and the outer cam surfaces to compound the gyration of the workpiece to maintain normalty between grinder and work surface. Other means to maintain normalty where a cam is employed include the use of spur gears. In grinding a complex contour, or for that matter, milling a complex profile, means must be provided for guiding the center of the cutter or the grinding wheel in a predetermined path. If, for any reason, the diameter of the cutter or the grinding wheel would change to a larger or smaller size, it would undercut the part in some places or leave stock on the part in other places and would not produce the correct profile, except if the profile were a true circle. To overcome this problem, a pivoting slide has been provided to allow the grinding spindle to be adjusted for different wheel sizes by rotating the slide so that the infeed takes place in the normal plane, as described above. On my U.S. Pat. No. 3,663,188, the infeed slide was passed through the center of a stationary plane, which intersected the center of the grinding spindle and the cam follower. In that machine, the cam and the part rotated together and adjusted themselves so that the contact point between the grinding wheel and the trochoid and the follower and the cam remained always on the stationary normal plane.

Where the stator housing to be machined is for a large engine which approaches or exceeds 1000 horse power per cavity and can weight several thousand pounds, alternate simpler machinery is required to properly machine the peretrochoidal contour. Attempts have been made to produce accurate peritrochoidal cavities for such very large rotary combustion engines by numerical controlled machines using rectangular coordinates. The results have been far from satisfactory.

In grinding contour profiles of any shape, whether cams, mechanical linkages, numerical control or gears are employed, it is necessary to provide for a normalty control so that, as the grinding wheel wears, the contour and size of the work piece remains unchanged. Cam-controlled machines have been designed with tapered followers which provide a means for adjustment as the grinding wheel wears.

SUMMARY OF THE INVENTION

In accordance with the teachings of the present invention, applicant has provided an improved grinding machine for grinding to extremely accurate dimensions both external and internal surfaces. Applicant's machine is particularly suited for grinding internal surfaces as, for example, the internal cavity of the stator part of a Wankel type engine. The instant invention is more particularly able to machine the stator of a very large Wankel engine where the workpiece might weigh several thousand pounds.

In construction, the grinding apparatus of the present invention includes a turntable on which the workpiece is held and is rotated. An annular cam, whose inner surface corresponds to the surface to be machined, is connected to and also rotates with the turntable. A grinding wheel whose rotational axis is generally parallel to that of the axis of rotation of the turntable is made to grind the desired contour by following the contour of the cam. Normalcy between work surface contour and grinding wheel is maintained by pivoting the support means for the grinder about the axis of the attached cam follower which is parallel to the axis of the turntable. By continually adjusting the pivotal angle of the grinder support to predetermined angles, based on the rotational position of the turntable, and properly in-feeding the grinding wheel to the work surface, normalcy is maintained while automatically compensation for grinder wheel wear.

In accordance with these and other objects which will be apparent hereafter, the instant invention will now be described with particular reference to the accompanying drawings.

DESCRIPTION OF THE PREFERRED EMBODIMENT

Figure 1:
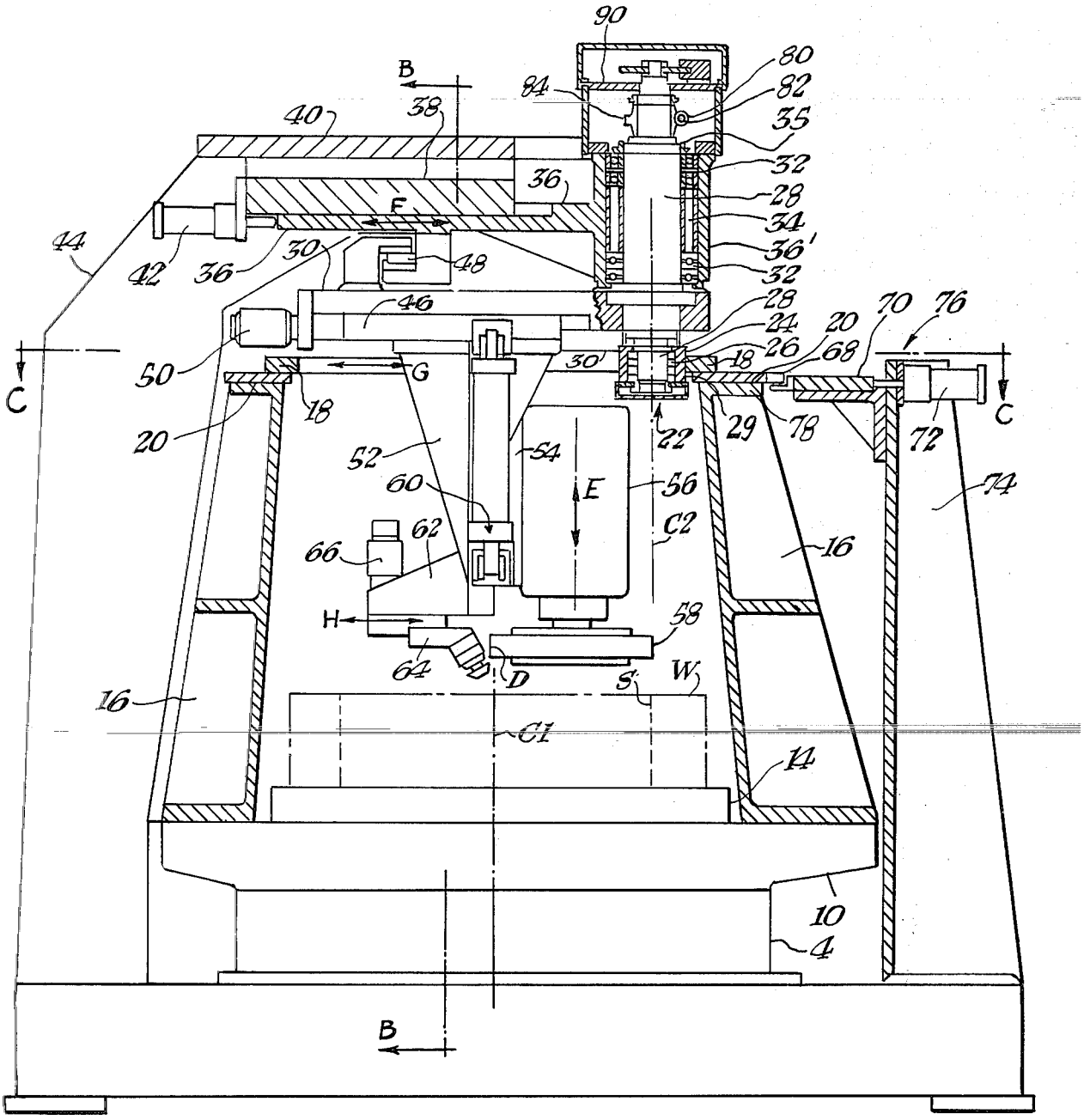
FIG. 1 is a side view, partially in cross-section, of the preferred embodiment of the grinding apparatus of the present invention.
Figure 2:
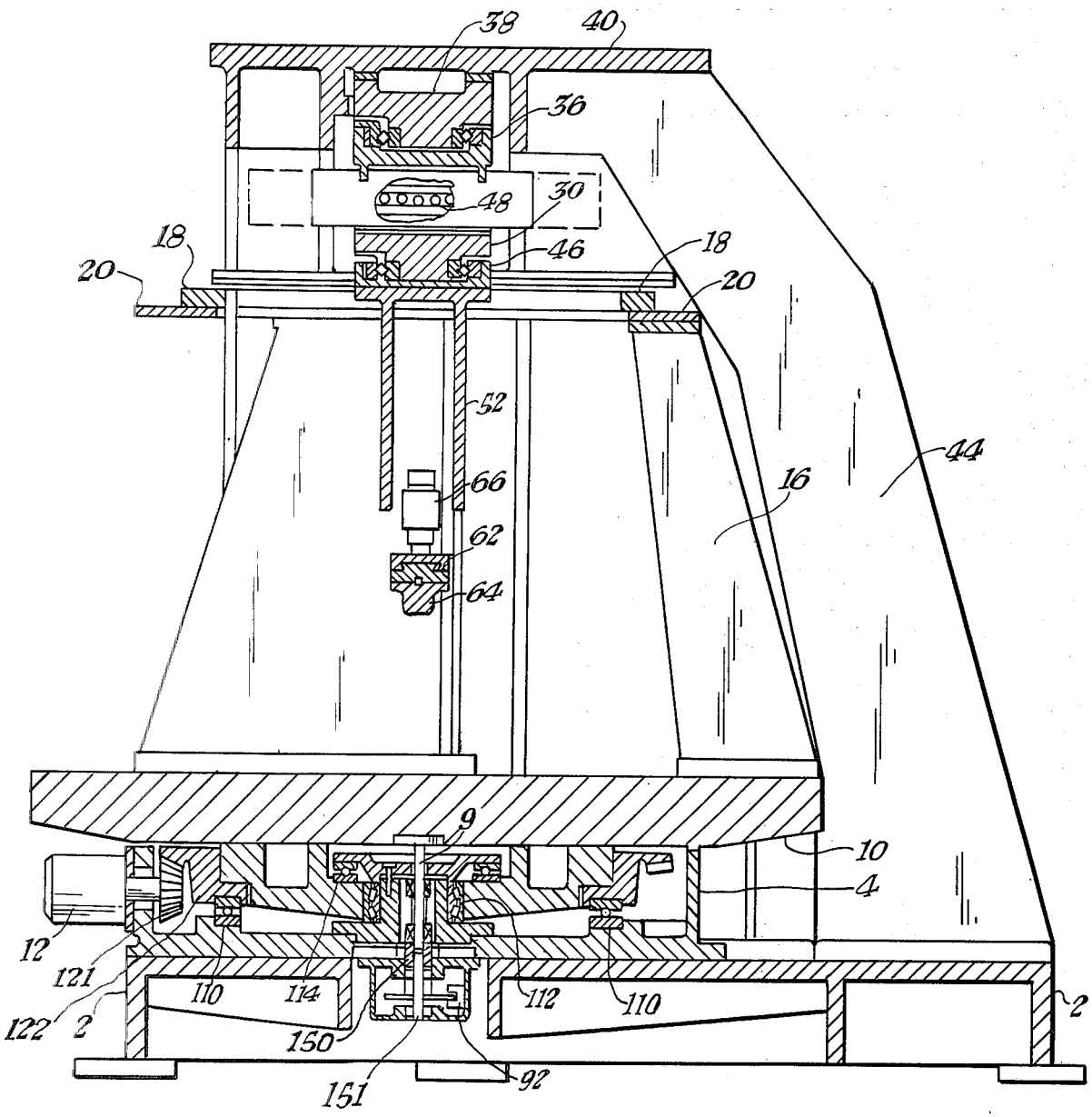
FIG. 2 is a cross-sectional view taken along lines B—B of FIG. 1.
Figure 3:
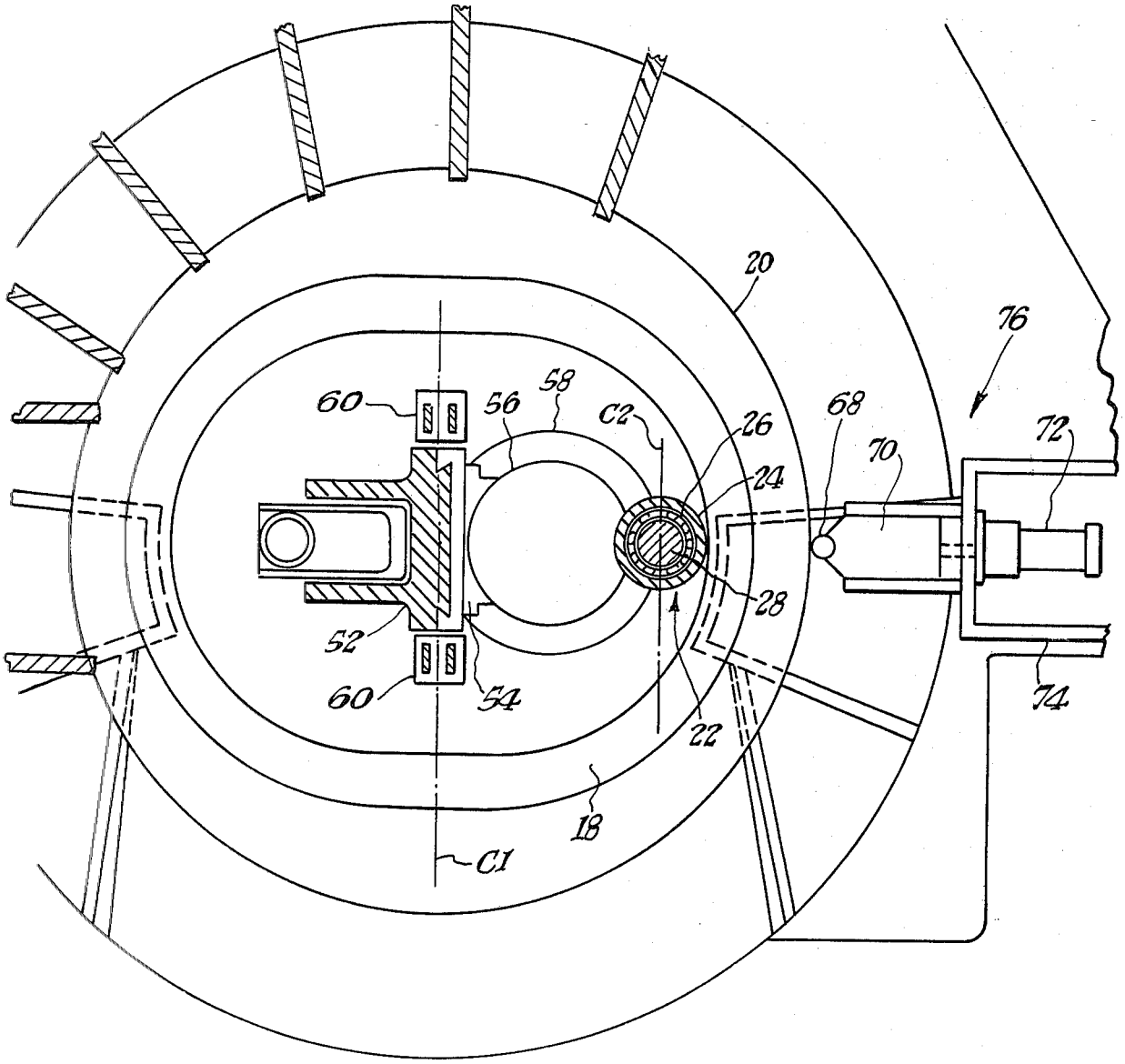
FIG. 3 is a cross-sectional view taken along lines C—C of FIG. 1.

Referring now to the drawings, and firstly to FIGS. 1 and 2, the grinding apparatus includes a base 2 on which is mounted turntable base 4. The turntable base 4 rotatably supports turntable 10 through a plurality of bearings 110, 112 and 114 in FIG. 2 and houses a variable speed motor 12 for rotating turntable 10 about centerline C1 through turntable shaft 9. Shaft 9 is connected to and perpendicularly disposed to the center of turntable 10. A DC motor 12 has a conical level gear pinion 121, meshing with and driving conical level gear 122 which is fixed to the lower surface of turntable 10. Work piece W is held securely to the upper surface of turntable 10 by fixture 14. Annular-shaped cam member 18 is supported by a plurality of cam supports 16. Ring 20, also annular-shaped, connects cam member 18 to supports 16. Wheel-shaped cam follower 22 contacts cam member 18 at line 29 and rotates about axis C2 as cam member 18 is revolved along with workpiece W and supports 16 by turntable 10.

Cam followers 22 includes an outer circular tube 24, a pivotal shaft 28 and a bearing means 26 therebetween. Cam follower 22 is supported by first slide 36 which, in turn is supported by and linearly slidable with first slide guide 38 in direction F. Slide guide 38 is connected to base 2 by first slide guide support 44. Pivotal shaft 28 is held for rotation about centerline C2 by housing 36' which is perpendicularly disposed and integral to first slide 36. A plurality of bearings 32 and spacer 34 are preloaded by collar 35, which is threadably engaged to pivotal shaft 28. A plurality of bearings 32 align pivotal shaft 28 in housing 36' and allow pivotal shaft 28 to rotate. Cam follower 22 is held in rotatable contact with cam member 18 by biasing means 42, which is interconnected between first slide 36 and first slide guide 38.

Pivotal shaft 28 also includes second slide guide 30 which is perpendicularly disposed to pivotal shaft axis C2, and is free to pivot with pivotal shaft 28. Second slide guide 30 supports second slide 46, held for linear sliding motion in direction G, perpendicular to centerline C2. Second slide 46 includes third slide guide 52 perpendicularly disposed to second slide guide 46. Third slide 54 slidably engages third slide guide 52 and is connectable to grinding means 56. At least one third slide actuator 60 interconnects, supports, and positions, in direction E, third slide 54 to third slide guide 52. Step motor 50, interconnected between second slide guide 30 and second slide guide 46, controls sliding movement therebetween, thus regulating engagement of grinding means 56 to the workpiece W along S. Second slide guide 30 is further supported to first slide 36 through linear roller bearing 48 still allowing relative rotation about axis C2 therebetween.

Integral to third slide guide 52 is dressing means support 62 which carries grinder dressing means 64 and step motor 66. Dressing means 64 is slidably positioned on support 62 by step motor 66 in direction H, controlling engagement between dressing means 64 and grinding means 56 along line D.

Because cam member 18 will deflect when contacted by cam follower 22, thus causing unwanted distortion, the preferred embodiment of the instant invention includes a counterbalancing means 76, which nullifies any force input to cam member 18 by biasing means 42. Counterbalance 76 includes a contact wheel 68 which presses against the outer circular contour of annular-shaped ring 20, a hydraulic cylinder 72 attached to base 2 through support 74, and slide 70, interconnected between contact wheel 68 and hydraulic cylinder 72. Slide 70 is slidably supported by support 74 at surface 78.

Figure 4:
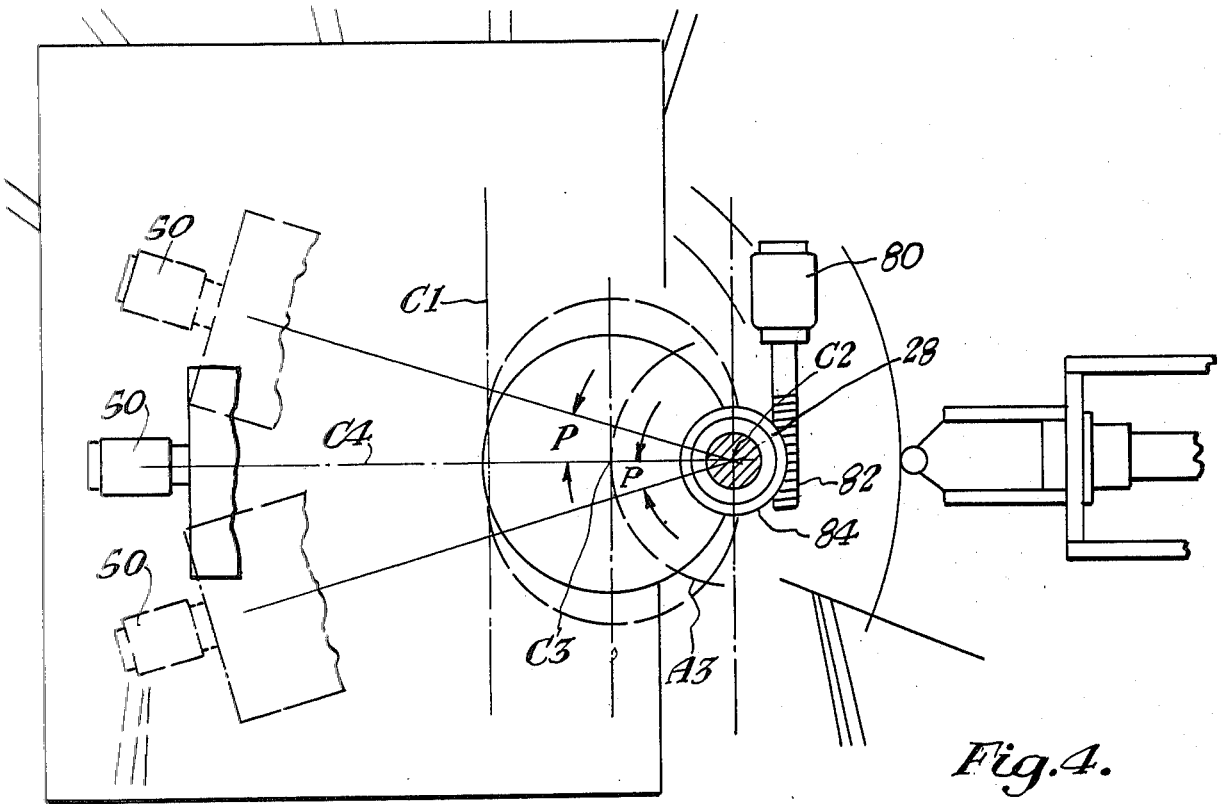
FIG. 4 is a partial plan view of the apparatus shown in FIG. 1.
Figure 5:
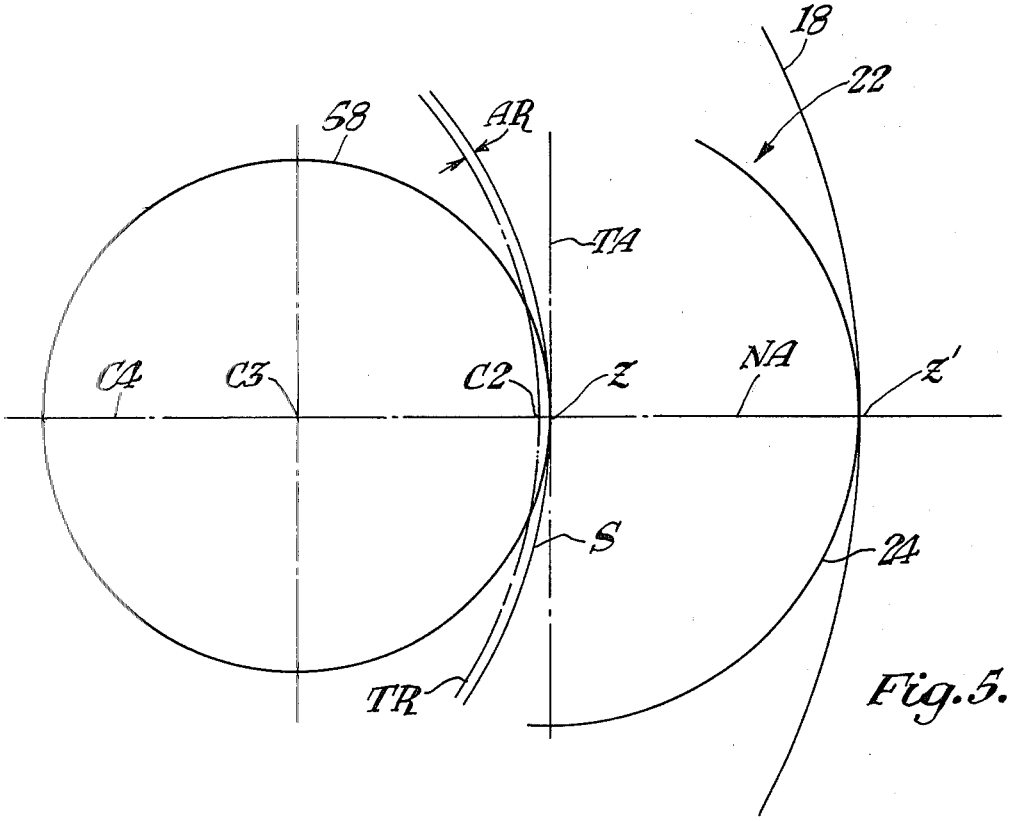
FIG. 5 is an expanded view of area D in FIG. 3 showing the interrelationship between grinder wheel, machine surface theoretical trachoid, and cam follower axis.

Referring to FIG. 4 the rotational positioning of pivotal shaft 28 about centerline C2 is governed by step motor 80. Step motor 80 drives worm 82 which engageably rotates worm gear 84. Worm gear 84 is securely fastened to pivotal shaft 28 so that a given output from step motor 80 results in a proportional pivoting of the centerline C3 of grinding means in FIG. 1 along the arc A3 in FIG. 4 an angle P. Second slide 30, and all connected components previously described, pivot the same angle P as shown in FIG. 4. Referring to FIG. 5, the proper value for angle P is that required to produce normalcy between plane NA and the tangent line TA, tangent to work surface contour 5 at the contact point Z between the grinding means and the work surface. Plane NA also passes through grinding means center line C3, cam follower centerline C2 and the contact point Z' between the cam and the cam follower.

The preferred embodiment of this invention is for grinding the peritrochoidal contour of the stator housing for a rotary combustion engine e.g. a Wankel design engine, line S in FIG. 5. Grinding means 58 contacts surface S at Z. However, the axis C2 about which centerline C4 is chosen to be pivoted, which coincides with the axis of rotation of cam follower 22, lies on the trochoid or well-known theoritical curve TR for a particular engine design. The peritrochoidal contour, which is the stator surface S, is established by design to be a distance AR larger than the trochoid. This distance AR has been established in this embodiment to equal the design radius of the apex seals for the rotor. It is here noted that any point along centerline C4 could be utilized to locate pivotal axis C2.

Figure 6:
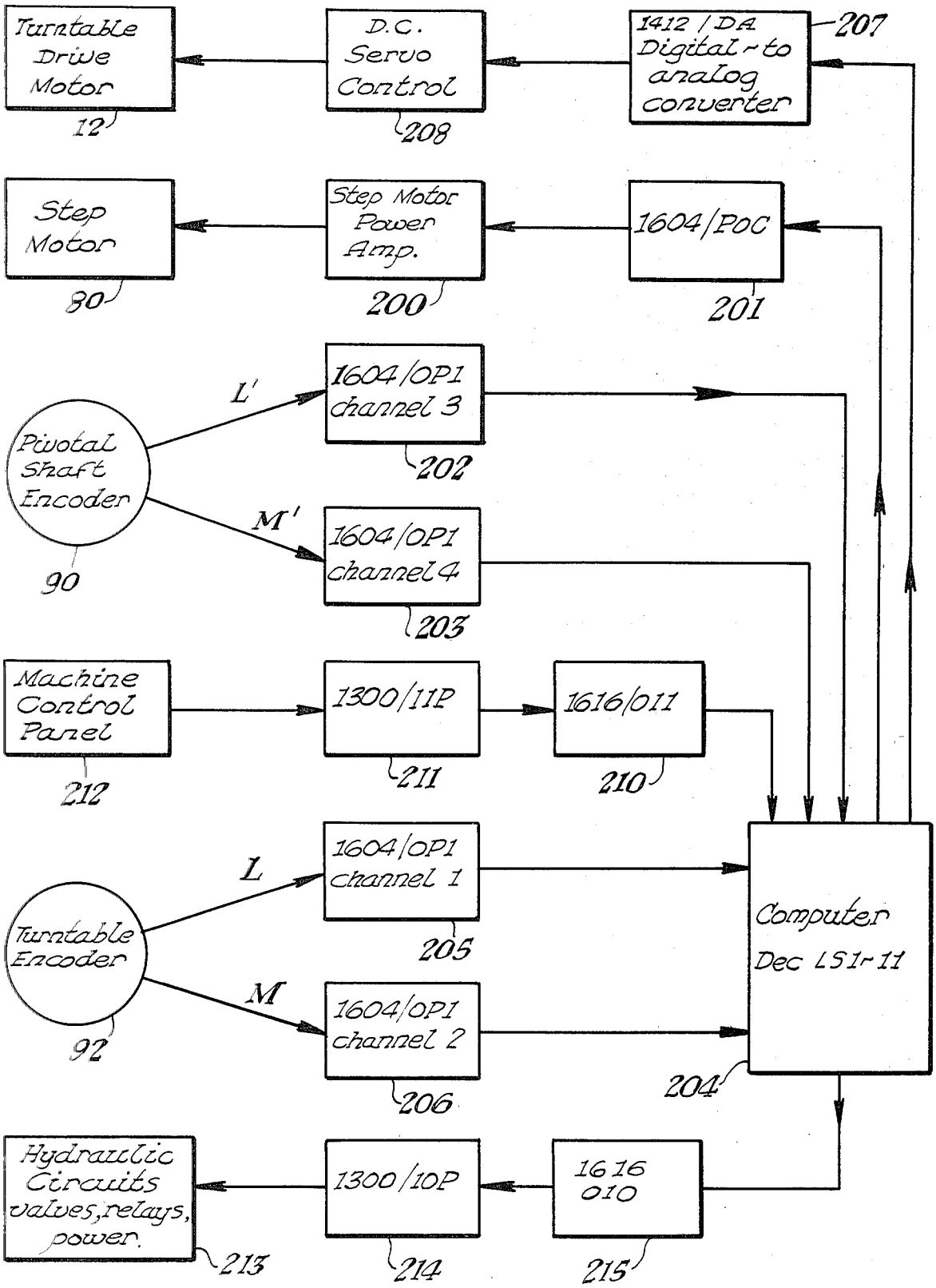
FIG. 6 is a diagram of the control circuit for this invention.

FIG. 6 depicts the control elements for the instant invention, some of which are also shown in FIGS. 1 and 2. Turntable 10 includes an optical incremental encoder 92 mounted on shaft 151 which is driven by shaft 9 through coupling 150. The encoder 92 generates a position pulse in multiples of 360° and one zero pulse per revolution of the turntable. The position pulse L is fed into a rotational position sensor logic circuit 205 of the type commonly sold under the trade designation 1604/OP1 by Adac Corp. The zero pulse M is fed into a second 1604/OP1 at numeral 206. The outputs from these modules interface with computer 204, of the type commonly sold under the trade designation DEC. LS1-11, by Digital Equipment Corp. The computer 204 is programmed (discussed below) to position pivotal shaft 28 to the grinding means normalty angle P in FIG. 4 required for the particular angular position of the turntable. This normalty positioning of pivotal shaft 28 is accomplished by one of the computer's outputs first being modified by pulse output controller 201 of the type commonly sold under the trade designation 1604/POC by Adac Corp., next being amplified by amplifier 200 and finally regulating step motor 80 which sets the proper angular position of shaft 28. Pivotal shaft encoder 90 serves as a feedback by reading the angular position of shaft 28. Encoder 90 emits a position pulse L; which inputs to rotational position sensor logic circuit 202 of the type commonly sold under the trade designation 1604/OP1 by Adac Corp; and also emits a zero position which inputs to another 1604/OP1 logic circuit 203. The outputs from logic circuits 202 and 203 interface with computer 204 and are compared with the outputs from logic circuits 205 and 206. If there is a slight error in the count, the computer will take the appropriate action to feed more or less steps to step motor 80 until the error has been corrected.

Based upon the angular position of the turntable (and consequently, the workpiece) the computer also controls the speed of DC motor 12 so that the work surface-to-grinding means velocity remains relatively constant. This is accomplished by increasing or decreasing the voltage to the stator of motor 12, by DC servo control 208 which is controlled by a digital-to-analog converter 207 of the type commonly sold under Adac Corp's. trade designation 1412/DA. The computer sends pulses to converter 207 at a rate inverse to the radius of the work surface from centerline C1 at the grinding means contact point.

A machine control panel 212 inputs to the computer through a high voltage isolating input/output panel 211 and an optically isolated input/output card 210. Both are of the type commonly sold under the trade designation 1300/11P and 1616/011, respectively, by Adac Corp. Interface elements 210 and 211 serve to isolate machine operating voltage from the smaller computer voltage requirement. This entire circuit is for starting and stopping the machine, checking slide positions by bydraulic pressure, and other operating safety factors.

Another computer-programmed function is to regulate all machine control elements 213. This is accomplished by feeding a proper computer output into another interfacing optically isolated input/output card, then into a high voltage isolation input/output panel 214. Both are of the type commonly sold under the trade designation 1616/010 and 1300/10P, respectively, by Adac Corp. Isolation of machine and computer operating voltage, as previously described, is the main function of these two elements.

Figure 7:
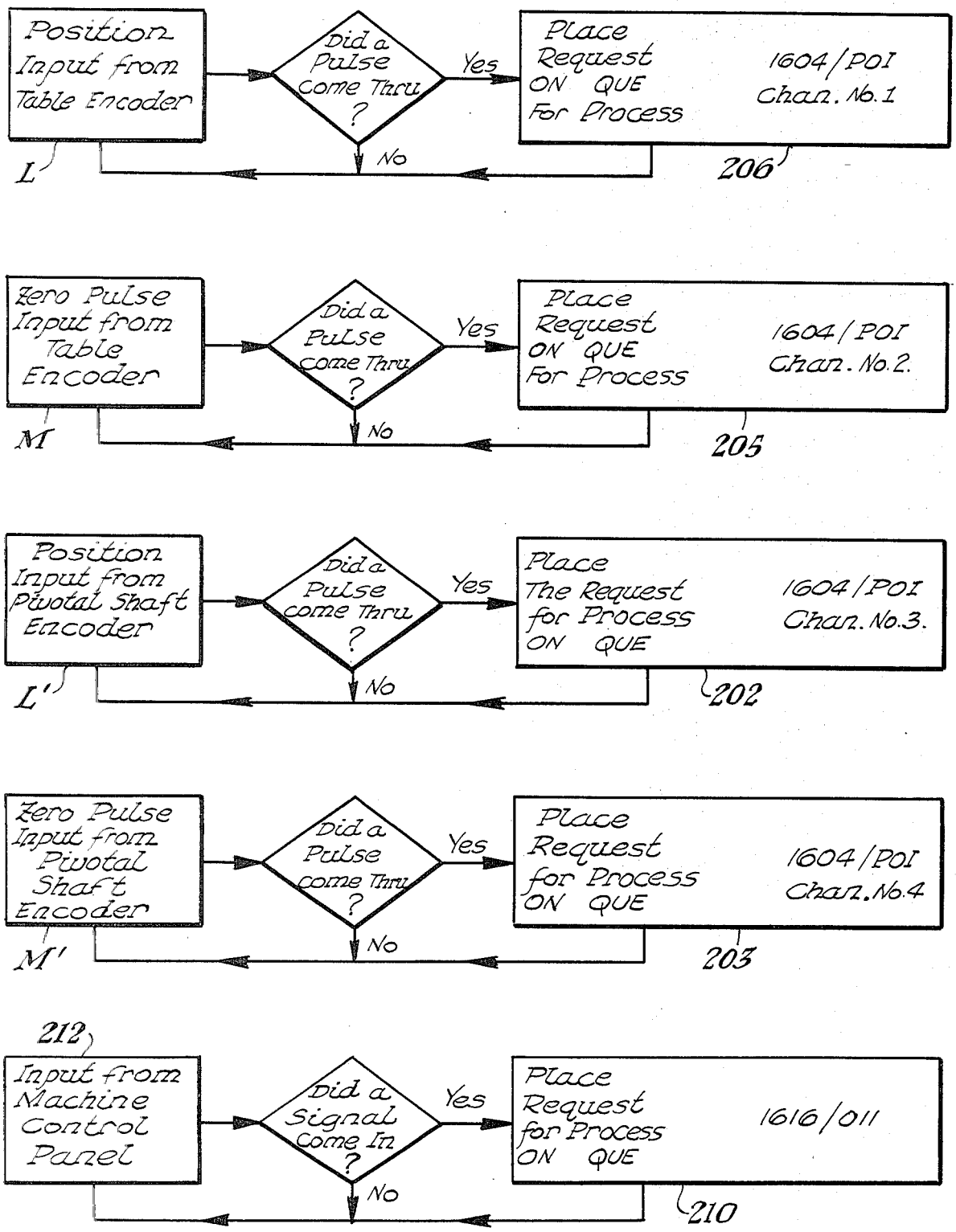
FIG. 7 is a diagram of the input signals to the computer.

FIG. 7 is a summary of all computer inputs including all four encoder channel inputs, L, M, L' and M', and machine control panel inputs 212. Whenever an input pulse is generated by any of the four input channel sources or any control signal is received from the control panel, that request is placed on a que, soliciting computer response.

Figure 8A:
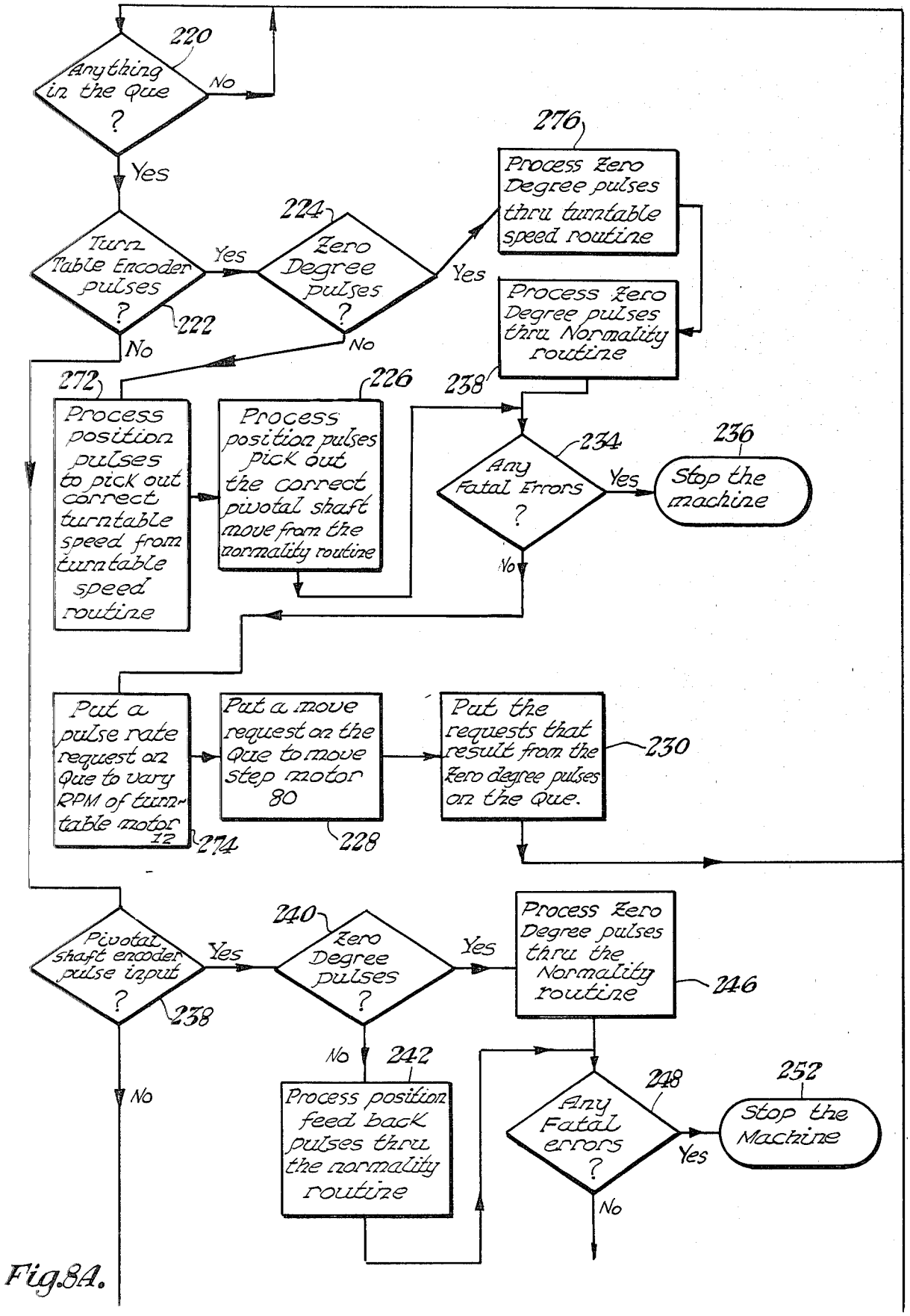
FIGS. 8A and 8B are a diagram of the internal logic circuit of the computer.
Figure 8B:
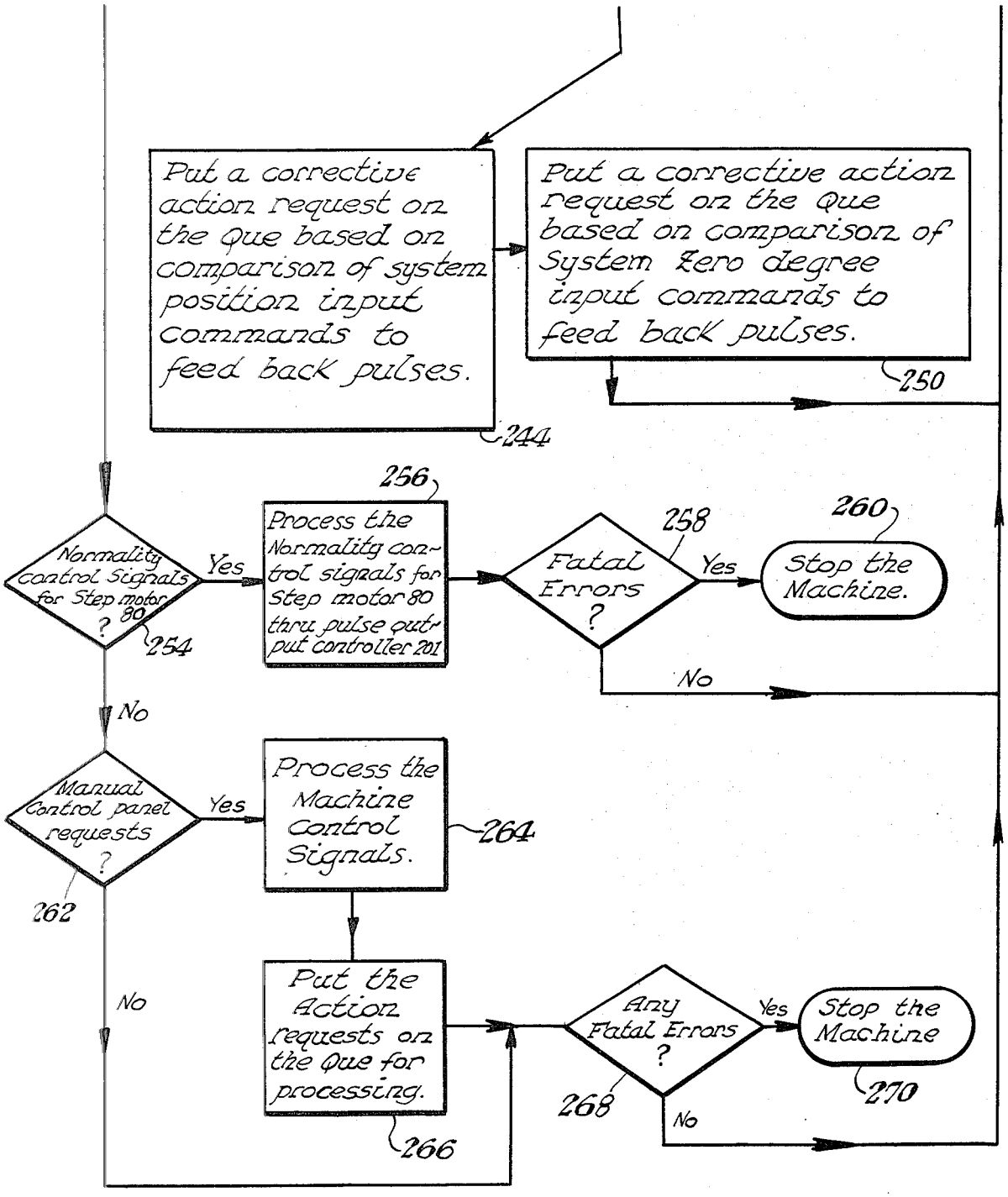

FIGS. 8A and 8B represent the logic control circuit programmed within the computer. The first question asked by the computer at numeral 220 is whether there is anything on the que. If not, the computer will leap until intercepted by a signal being placed on the que. If there is, the next question the computer asks at numeral 222 is whether there are turntable encoder inputs. If there are, this results in one of three subsequent steps at 228, 230 or 236. If there is no zero degree location pulses at 224, a move request 228 is placed on the que to move step motor 80 according to the turntable routine. If there is a zero degree location pulse on the que, a request 230 is placed on the que based upon the programmed routine 232, assuming no fatal pre-programmed errors 234 accuring which would stop the machine 236.

The computer then compares system command signals issuing at numerals 228 or 230 with the pivotal shaft encoder feedback signals at numeral 238. At numeral 240, if there are zero degree location type pulses, they are processed through the normalty routine at numeral 246. If there are no fatal system errors, a corrective action request is placed on the que at numeral 250 based on any difference between the response commanded by the computer and actuality as read by the pivotal shaft encoder. The same comparison process occurs with the location feedback pulses at numeral 242, resulting at 244, in a corrective action request being placed on the que, assuming no fatal system errors have occurred.

At numeral 254 all control pulses for the pivotal shaft step motor 80 which have been placed on the que are processed at numeral 256 by inputing the appropriate signal to the digital-to-analog converter 207 as previously discussed, if not fatal errors have occurred. All manual machine control panel requests at numeral 262 are properly processed at 256 with resulting action requests being placed on the que for processing at 266, and accomplished by the machine if no fatal errors have occurred.

An additional computer output function performed in conjunction with turntable encoder pulses at 222 is to control turntable rotational speed based upon the rotational turntable position to effectuate relatively constant work surface-to-grinding means velocity. If there are zero degree pulses at 224, they are processed through a turntable speed routine at 276, resulting requests being placed on the que at 230. Position pulses are also processed through the turntable speed routine at 272 resulting in a pulse rate request to vary the rotational speed of the turntable.

With minor changes and repositioning of follower and grinding spindle, external curve surfaces may be ground from external surface cams or internal surface cams. Internal curved surfaces can likewise be ground in machines with modifications from an external cam surface.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A grinding apparatus for grinding a surface on a workpiece comprising:
- a cam member having a surface with a changing radius of curvature corresponding to the contour of the surface to be ground on the workpiece;
- a means for supporting said cam member;
- a turntable on which the workpiece and said means for supporting said cam member are connected;
- a means for rotating said turntable;
- a stationary base for supporting said turntable and said means for rotating said turntable;
- a grinding means whose axis of rotation is parallel to the axis of rotation of said turntable;
- a cam follower whose axis of rotation is parallel to the axis of rotation of said turntable;
- a cam follower support means for supporting said cam follower;
- said cam follower support means linearly movable in response to movement of said cam follower;
- a grinder support means for supporting said grinding means;
- said grinder support means connected to said cam follower support means;
- said grinder means rotatable about the axis of said cam follower;
- said grinding means linearly movable in relation to said grinder support means into and away from the axis of said cam follower;
- said grinding means linearly movable in relation to said grinder support means parallel to the axis of said cam follower;
- a means for biasing said grinder support means such that said cam follower remains in contact with said cam and said grinding means is maintained in machinable contact with the work surface;
- a means for rotating said grinder support means about said cam follower axis to continuously maintain a normalty relationship between the tangent to the work surface contour at the point said grinding means contacts the work surface and a plane passing through the axes of said cam follower and said grinding means, said plane also passing through the contact points between said grinding means and the work surface and between said cam member and said cam follower;
- a means for linearly moving said grinding means into and away from the axis of said cam follower; and
- a means for linearly moving said grinding means parallel to the axis of said cam follower.

2. A grinding apparatus as recited in claim 1, wherein said cam member is fixed in a plane parallel to said turntable by said cam member support.

3. A grinding apparatus as recited in claim 2, wherein said cam follower is a rotatable wheel having a pivotal shaft, an outer circular tube, and a bearing means therebetween.

4. A grinding apparatus as recited in claim 3, wherein said pivotal shaft extends longitudinally beyond said outer circular tube in at least one direction.

5. A grinding apparatus as recited in claim 4, wherein said said cam follower support means includes:
- a first slide for supporting said pivotal shaft;
- a pivotal shaft housing integral to said first slide whose axis is perpendicular to said first slide;
- a pivotal shaft bearing between said pivotal shaft and said pivotal shaft housing for relative rotational movement therebetween;
- a first slide guide for linear movable cooperation with and support of said first slide; and
- a means for supporting said first slide guide interconnectable to said base.

6. A grinding apparatus as recited in claim 5, wherein said means for supporting said grinding means includes:
- a second slide guide integral to said pivotal shaft perpendicularly disposed to the axis of said pivotal shaft;
- a second slide supported by and for linear movable cooperation with said second slide guide;
- a third slide guide integral to said second slide perpendicularly disposed to said second slide; and
- a third slide supported by and for linear movable cooperation with said third slide guide, said third slide connectable to said grinding means.

7. A grinding apparatus as recited in claim 6, wherein said means for linearly moving said grinding means into and away from the axis of said cam follower is interconnected between said second slide and said second slide guide.

8. A grinding apparatus as recited in claim 7 further comprising a means for counterbalancing the portion of the biasing force applied to said cam member by contact with said cam follower, said counterbalancing means preventing distortion of said cam member.

9. A grinding apparatus as recited in claim 8, further comprising a means for maintaining substantially constant relative movement between said grinding means and the work surface at the contact point therebetween.

10. A grinding apparatus as recited in claim 9, further comprising a grinder dressing means for truing the surface of said grinding means, said grinder dressing means connected to said third slide guide for movable cooperation with said grinding means substantially perpendicular to said grinding means axis of rotation.

11. A grinding apparatus as recited in claim 10, further comprising a means for moving said grinder dressing means linearly in and out in relation to the axis of rotation of said grinding means.

12. A grinding apparatus as recited in claim 11, further comprising a means for controlling the movement of said means for linearly moving said grinding means into and away from the axis of said cam follower in relation to said means for moving said grinder dressing means in order to maintain proper said grinding means to work surface positioning as said grinding means wears.

13. A grinding apparatus as recited in claim 12, further comprising a means for controlling the rotational position of said grinder support means about the axis of said cam follower to maintain said normalty positioning, said control for said grinder support means functioning in response to rotational orientation of the workpiece.

14. A grinding apparatus as recited in claim 13 wherein said cam contour is a peritrochoid of a rotary combustion engine e.g. a Wankel stator, the contour of the work surface.

15. A grinding apparatus as recited in claim 14 wherein the axis of rotation of said cam follower is in planar relation to the trochoid of the Wankel stator to be ground, said trochoid proportionately smaller than the peritrochoid which represents the surface to be ground by an amount equal to the apex radius of the Wankel rotor seal.

* * * * *